US009557718B2

(12) United States Patent
Honda et al.

(10) Patent No.: US 9,557,718 B2
(45) Date of Patent: Jan. 31, 2017

(54) ELECTRONIC TIMEPIECE AND ELECTRONIC DEVICE

(71) Applicant: Seiko Epson Corporation, Tokyo (JP)

(72) Inventors: Katsuyuki Honda, Miyata (JP); Chisato Tezuka, Okaya (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/816,353

(22) Filed: Aug. 3, 2015

(65) Prior Publication Data

US 2016/0041532 A1 Feb. 11, 2016

(30) Foreign Application Priority Data

Aug. 6, 2014 (JP) ..... 2014-160384

(51) Int. Cl.
*G04B 19/22* (2006.01)
*G04R 20/02* (2013.01)

(52) U.S. Cl.
CPC ..... *G04R 20/02* (2013.01); *G04B 19/22* (2013.01)

(58) Field of Classification Search
CPC ..... G04B 19/22; G04C 11/02; G04G 9/0076; G04R 20/02
USPC ..... 368/21
See application file for complete search history.

(56) References Cited

U.S. PATENT DOCUMENTS 4,681,460 A * 7/1987 Nishimura ..... G04G 9/0076 368/21
5,724,316 A * 3/1998 Brunts ..... G01C 21/3697 340/988
6,219,303 B1 * 4/2001 Morohoshi ..... G04G 5/00 368/187
6,366,834 B1 * 4/2002 Hayes ..... G04G 9/0076 340/988
7,031,226 B2 * 4/2006 Farine ..... G04G 17/005 368/10
7,057,976 B2 * 6/2006 Berseth ..... A63B 71/0605 368/10
8,077,550 B2 * 12/2011 Akiyama ..... G04G 5/002 368/21
8,705,321 B2 4/2014 Akiyama et al.
2003/0081507 A1 * 5/2003 Kitazawa ..... G04G 9/0076 368/21
2006/0140056 A1 * 6/2006 Lizzi ..... G04B 19/23 368/21

(Continued)

FOREIGN PATENT DOCUMENTS

JP 2009-180528 A 8/2009

OTHER PUBLICATIONS

CUCM Versions—cisco.com/c/en/us/support/docs/unified-communications/unified-communications-manager-callmanager/118744-technote-cucm-00.html—Feb. 17, 2015.*

(Continued)

*Primary Examiner* — Sean Kayes
(74) *Attorney, Agent, or Firm* — Harness, Dickey & Pierce, P.L.C.

(57) ABSTRACT

An electronic timepiece has a storage unit (flash ROM) that stores local time information related to positioning information and time difference information, and version information of the local time information; a version display unit (display device) capable of displaying the version information; and a display control unit that displays the version information on the version display unit.

8 Claims, 12 Drawing Sheets

(56) References Cited

U.S. PATENT DOCUMENTS

2008/0056070 A1* 3/2008 Lin ..... G04B 19/223
368/21

OTHER PUBLICATIONS

IANA—iana.org/time-zones—Mar. 10, 2014.*

* cited by examiner

LOCAL TIME INFORMATION

352

351 3521 3522 3523 3524 3525 3526

| REGION INFORMATION | TIME ZONE INFORMATION | TIME ZONE CHANGE INFORMATION | DST OFFSET INFORMATION | DST START INFORMATION | DST END INFORMATION | DST CHANGE INFORMATION |
|---|---|---|---|---|---|---|
| REGION 1 | UTC+9 | – | 0 | – | – | – |
| REGION 2 | UTC+8 | 2014.10.26 2:00 UTC+9 | 0 | – | – | – |
| REGION 3 | UTC+7 | – | +1 | 1:00 LAST SUNDAY IN MARCH | 2:00 LAST SUNDAY IN OCTOBER | NO DST STARTING 2015 |
| ... | ... | ... | ... | ... | ... | ... |

35

FIG. 5

CHANGE HISTORY

| DATE | REGION | CHANGE |
|---|---|---|
| 2013.2.15 | Chile | DST CHANGE |
| 2013.3.7 | Paraguay | DST CHANGE |
| 2013.3.11 | Cuba | DST CHANGE |
| 2013.3.28 | Israel | DST CHANGE |
| 2013.4.15 | Palestine | DST CHANGE |
| 2013.7.2 | Morocco & Western Sahara | DST CHANGE |
| 2013.7.8 | Israel | DST CHANGE |
| 2013.8.16 | Chile Easter Island | DST CHANGE |
| 2013.9.4 | Fiji | DST CHANGE |
| 2013.9.24 | Palestine | DST CHANGE |
| 2013.9.30 | Morocco & Western Sahara | DST CHANGE |
| 2013.10.2 | Brazil | DST CHANGE |
| 2013.10.25 | Libya | TIME ZONE CHANGE |
| 2013.11.4 | Brazil | TIME ZONE CHANGE |
| 2013.12.11 | Jordan | TIME ZONE CHANGE |

FIG. 6

LOCAL TIME INFORMATION 371 372

| 3711 CITY CODE | 3712 CITY NAME | 3721 TIME ZONE INFORMATION | 3722 DST OFFSET INFORMATION | 3723 DST START INFORMATION | 3724 DST END INFORMATION |
|---|---|---|---|---|---|
| LON | London | UTC+0 | +1 | 1:00 LAST SUNDAY IN MARCH | 2:00 LAST SUNDAY IN OCTOBER |
| PAR | Paris | UTC+1 | +1 | 2:00 LAST SUNDAY IN MARCH | 3:00 LAST SUNDAY IN OCTOBER |
| ATH | Athens | UTC+2 | +1 | 3:00 LAST SUNDAY IN MARCH | 4:00 LAST SUNDAY IN OCTOBER |
| ... | ... | ... | ... | ... | ... |
| TYO | Tokyo | UTC+9 | – | – | – |
| ... | ... | ... | ... | ... | ... |

37

FIG. 11

ELECTRONIC TIMEPIECE AND ELECTRONIC DEVICE

BACKGROUND

1. Technical Field

The present invention relates to an electronic timepiece and to an electronic device.

2. Related Art

Electronic timepieces that store positioning information and local time information, which relates time zone information including information related to DST (daylight saving time) and the time difference to UTC (Coordinated Universal Time) at the location identified by the positioning information, and calculate the time corresponding to the positioning information acquired using the local time information, are known from the literature. See, for example, JP-A-2009-180528.

However, the local time information (local time) may change according to time zone changes and changes in DST. To accommodate such changes, the local time information stored in the electronic timepiece may be updated when the timepiece is serviced, for example.

A problem with the electronic timepiece disclosed in JP-A-2009-180528 is that whether or not the stored local time information is the latest cannot be confirmed. As a result, the electronic timepiece must be connected to a maintenance device to check the content of the local time information stored in the electronic timepiece, and determining whether or not the local time information requires updating is not easy.

SUMMARY

An electronic timepiece and an electronic device according to the present invention enable easily checking the version of the stored local time information.

To achieve the foregoing objective, an electronic timepiece according to the invention includes a storage unit that stores local time information related to positioning information and time difference information, and version information of the local time information; a version display unit capable of displaying the version information; and a display control unit that displays the version information on the version display unit.

Thus comprised, the display control unit displays the version information stored in the storage unit on the display unit.

The version information is information, such as a number, identifying the version (or edition) of the local time information, and different information is applied when the content of the local time information changes. For example, if the same version information is assigned to two sets of local time information, the two sets of local time information have the same content. The user or service technician can therefore determine if the local time information is the same by referencing the version information.

Thus comprised, the user or service technician can easily confirm the version of the local time information stored in the storage unit. As a result, the user or service technician can easily determine if the local time information requires updating by referencing the version information, for example.

An electronic timepiece according to another aspect of the invention preferably also has a satellite signal receiver unit that receives satellite signals transmitted from positioning information satellites; a time information acquisition unit that acquires time information based on the satellite signal received by the satellite signal receiver unit; a positioning information acquisition unit that acquires positioning information based on the satellite signal received by the satellite signal receiver unit; a time difference information acquisition unit that acquires time difference information related to the positioning information from the local time information; a time calculating unit that computes a display time based on the time difference information and the time information; and a time display unit that displays the display time.

Thus comprised, the time information acquisition unit gets time information based on satellite signals. The positioning information acquisition unit acquires positioning information based on the satellite signals. The time difference information acquisition unit gets the time difference information corresponding to the positioning information acquired by the positioning information acquisition unit from the local time information. The time calculating unit computes the display time based on the time difference information and the time information. The display control unit then controls the time display unit to display the current time at the location corresponding to the positioning information. Thus comprised, whether or not the local time information must be updated can be easily determined when new local time information is provided, and the local time information can more reliably be updated to the latest version. The current time at the current location can therefore be accurately displayed when positioning information and time information are acquired based on satellite signals.

An electronic timepiece according to another aspect of the invention preferably also has an input unit that detects a manual operation and sets the positioning information; a standard time signal receiver unit that receives standard time signals; a time information acquisition unit that acquires time information based on the standard time signal received by the standard time signal receiver unit; a positioning information acquisition unit that acquires the positioning information set by the input unit; a time difference information acquisition unit that acquires time difference information related to the positioning information from the local time information; a time calculating unit that computes a display time based on the time difference information and the time information; and a time display unit that displays the display time.

Thus comprised, the time information acquisition unit gets time information based on standard time signals. The positioning information acquisition unit acquires positioning information set by the input unit. The time difference information acquisition unit gets the time difference information corresponding to the positioning information acquired by the positioning information acquisition unit from the local time information. The time calculating unit computes the display time based on the time difference information and the time information. The display control unit then controls the time display unit to display the current time at the location corresponding to the positioning information. Thus comprised, whether or not the local time information must be updated can be easily determined when new local time information is provided, and the local time information can more reliably be updated to the latest version. The current time at the location corresponding to the positioning information set by the input unit can therefore be accurately displayed.

An electronic timepiece according to another aspect of the invention preferably also has an operating unit that receives an operating command displaying the version information;

and the display control unit displays the version information when the operating unit receives this display command operation.

Thus comprised, the display control unit displays the version information when a specific display command operation for displaying the version information is received through the operating unit. The user or service technician can therefore display the version information at the desired time, such as during maintenance, by operating the operating unit. Checking the version information is therefore easier and more convenient.

In an electronic timepiece according to another aspect of the invention, the storage unit rewritably stores the local time information and the version information.

Thus comprised, the storage unit rewritably stores the local time information and the version information. The storage unit can therefore rewrite only the local time information and version information. The amount of data to overwrite can therefore be reduced and productivity can be improved compared with a configuration in which other data stored in the storage unit (such as settings for driving the electronic timepiece) is also overwritten at the same time.

Further preferably in an electronic timepiece according to another aspect of the invention, the local time information includes region information corresponding to the positioning information, and time zone information corresponding to the time difference information and indicating the time difference of the region information to UTC; and includes relationally to the time difference information at least one of time zone change information indicating a scheduled time zone change, daylight saving time offset information, daylight saving time start information, daylight saving time end information, and daylight saving time change information indicating a scheduled change in daylight saving time.

The time zone information is information indicating the time difference to UTC. The time zone change information is information indicating scheduled time zone changes, such as when the time zone information changes and the time difference to UTC after the time zone change.

The daylight saving time offset information (DST offset information) is information indicating the time change for daylight saving time. The daylight saving time start information (DST start information) is information indicating when daylight saving time starts, and the daylight saving time end information (DST end information) is information indicating when daylight saving time ends. The daylight saving time change information (DST change information) is information is information indicating a scheduled change in daylight saving time, such as when DST is in effect and the offset after the change takes effect.

The local time information includes region information and time zone information corresponding to the time difference information, and includes at least one of the time zone change information, DST offset information, DST start information, DST end information, and DST change information as the time difference information. This information changes according to the time zone and DST changes, for example. Therefore, by displaying the version information on the display unit, whether or not the the local time information stored in the storage unit matches the changes can be easily determined when any of the information changes.

An electronic timepiece according to another aspect of the invention preferably also has a time display unit with a plurality of hands that indicate the display time. The time display unit is used as the version display unit; and the display control unit displays the version information on the time display unit by setting the hands to positions indicating the version information.

Thus comprised, a time display unit having a plurality of hands embodies the version display unit. By moving the hands to positions indicating the version information, the display control unit can display the version information on the time display unit. For example, if the hands include an hour hand and a minute hand, and the version information is Ver. 2.35, the version information can be displayed by moving the hands to 2:35. By thus correlating the positions of the hands to the version information, the version information can be easily checked without providing a separate display unit for displaying the version information.

Another aspect of the invention is an electronic device including: a storage unit that stores local time information related to positioning information and time difference information, and version information of the local time information; a version display unit capable of displaying the version information; and a display control unit that displays the version information on the version display unit.

As with the electronic timepiece described above, the display control unit in this aspect of the invention displays the version information stored in the storage unit on a version display unit. The user or service technician can therefore easily confirm the version of the time information stored in the storage unit. Problems such as the update process not executing even though the local time information is not the latest, and the update process executing even though the local time information is the most recent, can therefore be avoided.

Other objects and attainments together with a fuller understanding of the invention will become apparent and appreciated by referring to the following description and claims taken in conjunction with the accompanying drawings.

BRIEF DESCRIPTION OF THE DRAWINGS

FIG. 5 shows an example of local time information in the first embodiment of the invention.

FIG. 6 shows an example of a history of changes to time difference information.

FIG. 11 shows an example of local time information in the second embodiment of the invention.

DESCRIPTION OF EMBODIMENTS

Preferred embodiments of the present invention are described below with reference to the accompanying figures.

Embodiment 1

Figure 1:
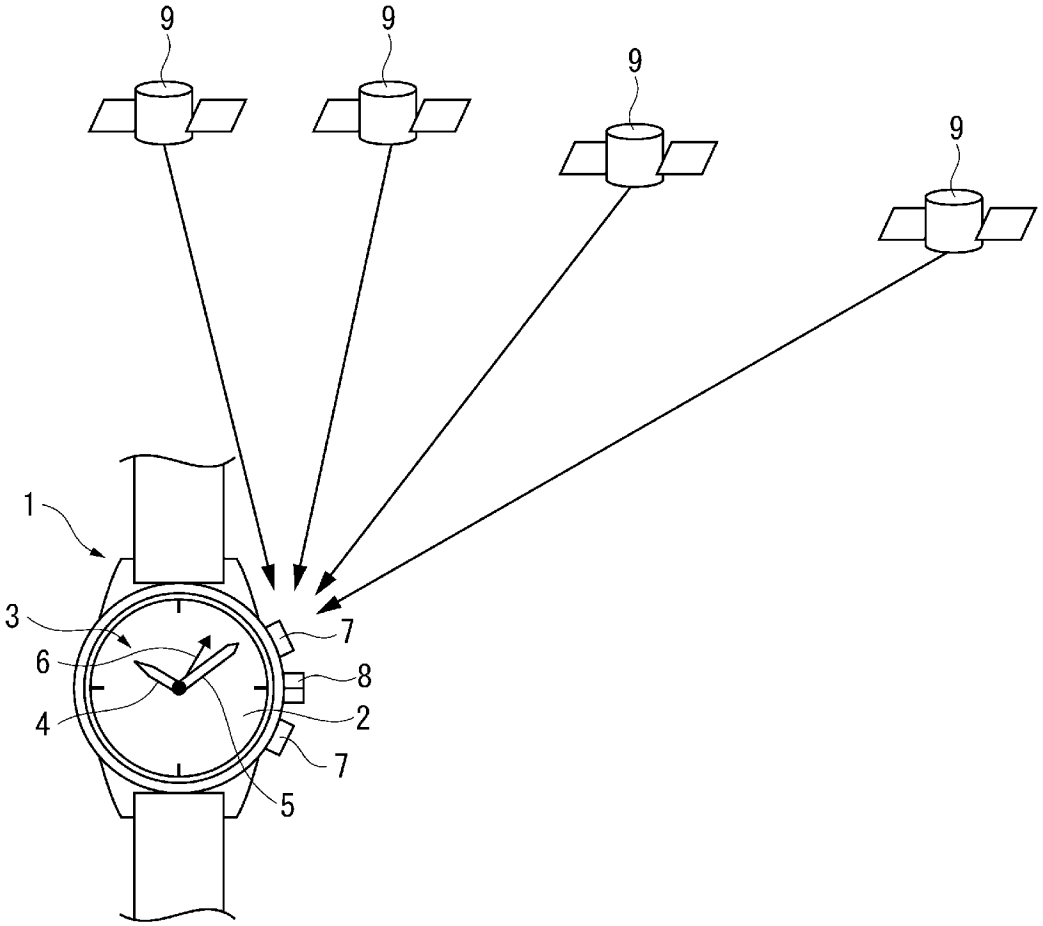
FIG. 1 illustrates an electronic timepiece according to a first embodiment of the invention.

FIG. 1 shows an example of an electronic timepiece 1 according to the invention.

The electronic timepiece 1 according to this embodiment is a wristwatch with an internal GPS satellite signal receiver. As shown in FIG. 1, the electronic timepiece 1 is an analog timepiece with a dial 2 and hands 3. The hands 3 include an hour hand 4, minute hand 5, and second hand 6, and are driven by a stepping motor through a wheel train.

The electronic timepiece 1 has buttons 7 and a crown 8 as input devices (external operating members).

Note that a window may be formed in the dial 2 to accommodate an LCD display panel or other display device (digital display device).

The electronic timepiece 1 can receive satellite signals and acquire satellite time information from multiple GPS satellites 9 orbiting the Earth on known orbits to adjust the internal time based on the received satellite time.

The GPS satellites 9 are used as an example of positioning information satellites in this embodiment of the invention, and there are multiple satellites in orbit. There are currently approximately 30 GPS satellites 9 in service.

Electronic Timepiece Circuits

Figure 2:
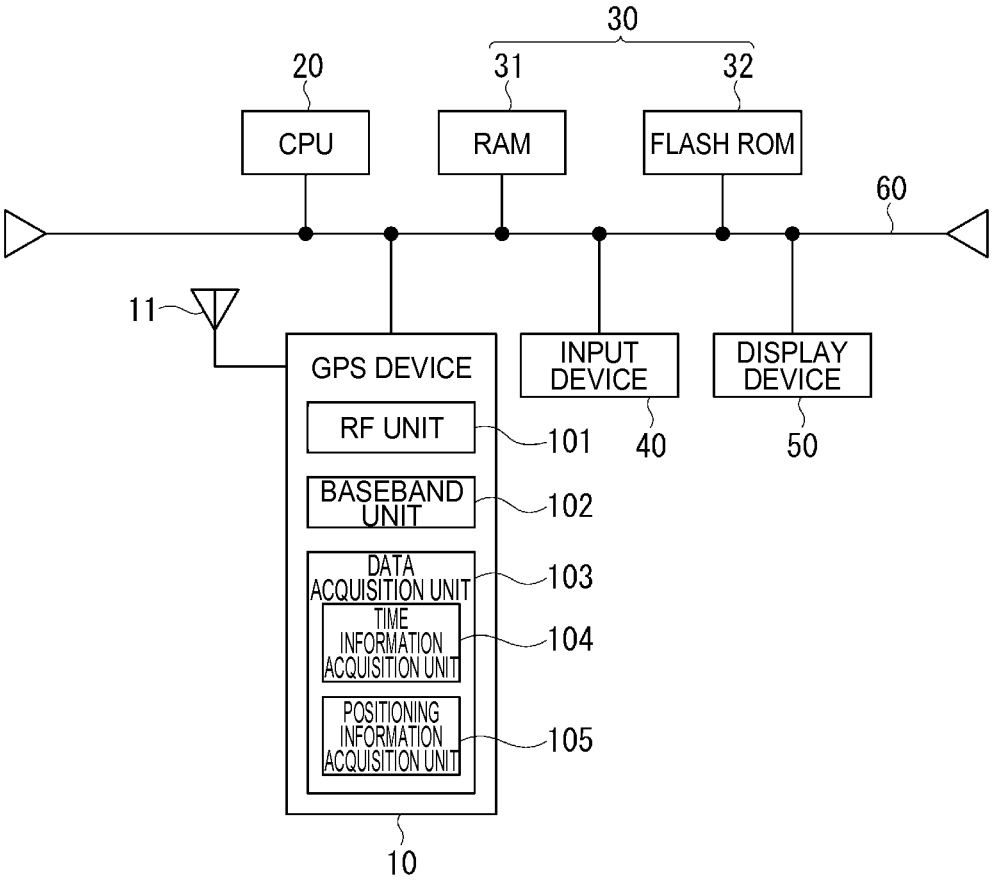
FIG. 2 illustrates the circuit design of the electronic timepiece according to the first embodiment of the invention.

FIG. 2 shows the basic circuit design of the electronic timepiece 1.

As shown in FIG. 2, the electronic timepiece 1 includes a GPS device 10 (GPS module) as the satellite signal receiver, control device 20 (CPU), storage device 30, input device 40 as an operating unit, and a display device 50 as the time display unit and version display unit. These devices are interconnected by a data bus 60.

The electronic timepiece 1 also has an internal battery as the power supply. The battery may be a primary battery or a rechargeable storage battery.

GPS Device Configuration

The GPS device 10 includes a GPS antenna 11, processes satellite signals received through the GPS antenna 11, and acquires GPS time information and location information.

The GPS antenna 11 receives the satellite signals transmitted from a plurality of GPS satellites 9 orbiting the Earth in space on specific orbits. The GPS antenna 11 may be a ring antenna disposed around the outside circumference of the dial 2, or a patch antenna disposed on the back side of the dial 2, for example.

The GPS device 10 includes an an RF (radio frequency) unit 101 that receives and converts satellite signals transmitted from the GPS satellites 9 to digital signals; a baseband unit 102 that executes a reception signal correlation process and demodulates the navigation data message; and a data acquisition unit 103 that acquires time information and positioning information based on the navigation data message (satellite signals) demodulated by the baseband unit 102.

The RF unit 101 includes a bandpass filter, PLL circuit, IF filter, VCO (voltage controlled oscillator), ADC (A/D converter), mixer, LNA (low noise amplifier), and IF amplifier.

The satellite signal extracted by the bandpass filter is amplified by the LNA, mixed by the mixer with the signal from the VCO, and down-converted to an IF (intermediate frequency) signal. The IF signal mixed by the mixer then passes through the IF amplifier and IF filter, and is converted by the A/D converter to a digital signal.

The baseband unit 102 has a local code generator and a correlation unit. The local code generator generates local codes that are the same as the C/A codes used by the GPS satellites 9 for signal transmission. The correlation unit calculates the correlation between the local codes and the reception signal output from the RF unit 101.

If the correlation calculated by the correlation unit equals or exceeds a specific threshold, the C/A code used in the received satellite signal and the local code that was generated match, and the satellite signal can be locked (synchronized). The navigation data message can therefore be demodulated as a result of the correlation process using the received satellite signal and a local code.

The data acquisition unit 103 has a time information acquisition unit 104 that acquires the time information from the navigation data message demodulated by the baseband unit 102, and a positioning information acquisition unit 105 that acquires positioning information from the demodulated navigation data message. More specifically, the navigation data message transmitted from a GPS satellite 9 contains preamble data, the TOW (Time of Week, also called the Z count) of the HOW word, and subframe data. There are five subframes, subframe 1 to subframe 5, and each subframe contains satellite correction data including a week number value and satellite health data, ephemeris data (detailed orbit information for a particular GPS satellite 9), and almanac data (basic orbit information for all GPS satellites 9).

The time information acquisition unit 104 of the data acquisition unit 103 can therefore extract specific data from the received navigation data message to acquire time information, and the positioning information acquisition unit 105 can likewise acquire positioning information from the navigation data message.

Input Device and Display Device

The input device 40 includes the buttons 7 and crown 8 as external operating members. Note that as described further below, the input device 40 functions as an operating unit that accepts display command operations for displaying version information.

The display device 50 includes the dial 2 and hands 3 that are driven by a stepping motor and wheel train to display the time.

Storage Device Configuration

The storage device 30 includes RAM 31 and flash ROM 32.

Figure 3:
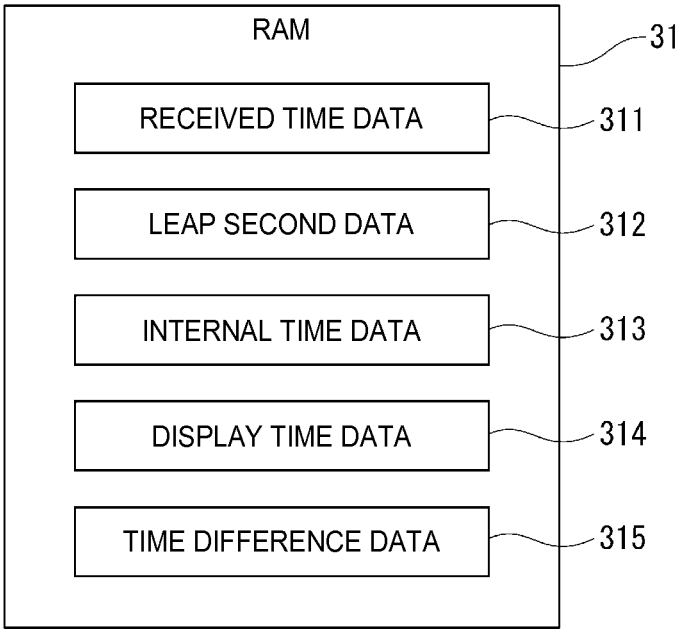
FIG. 3 illustrates the structure of data stored in RAM.

As shown in FIG. 3, a storage area for storing time data and time zone data is reserved in RAM 31. More specifically, storage areas for storing received time data 311, leap second data 312, internal time data 313, time data for display 314, and time difference data 315 are provided in RAM 31.

The received time data 311 stores the time information (GPS time) acquired from GPS satellite signals. The leap second data 312 stores at least data about the current leap second. More specifically, data related to the leap second, that is, the current leap second value, the week number of the leap second event, the day number of the leap second event, and the future leap second value, is stored on page 18 in subframe 4 of the GPS satellite signal. Of these values, at least the current leap second value is stored in the leap second data 312.

The internal time data 313 stores internal time information. More specifically, when the GPS satellite signal is received and the received time data 311 updated, the internal time data 313 is updated based on the GPS time stored in the received time data 311 and the current leap second value stored in the leap second data 312. As a result, the internal time data 313 is updated to UTC.

The internal time data 313 is normally updated every second based on a 1-Hz reference signal output from a crystal oscillator not shown, but when a satellite signal is received and the time information acquired, the internal time data 313 is updated based on the acquired time information. The internal time data 313 therefore stores the current UTC.

The time data for display 314 (display time data 314) stores the time obtained by adding the time difference data 315 to the internal time information of the internal time data 313. The time difference data 315 is time difference information indicating the time difference to UTC, and is acquired based on the local time information described below (see FIG. 5).

Figure 4:
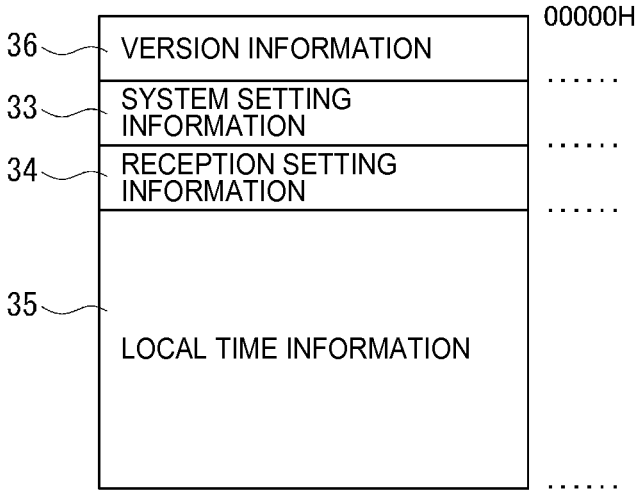
FIG. 4 illustrates the structure of data stored in flash ROM.

FIG. 4 shows an example of the structure of data stored in flash ROM 32.

Flash ROM 32 stores a program executed by the control device 20, and data used for executing the program. More specifically, as shown in FIG. 4, in addition to the system setting information 33 and reception setting information 34 for driving the electronic timepiece 1, local time information 35 described further below and version information 36 indicating the version (edition) of the local time information 35, are stored to specific addresses in flash ROM 32. The flash ROM 32 is an example of the storage unit in the accompanying claims.

Because flash ROM 32 is rewritable, the local time information 35 and version information 36 can be updated. Note that EEPROM or other type of rewritable memory can be used instead of flash ROM 32.

The system setting information 33 is information defining the positions of the hands, for example. As described further below, the version of the local time information 35 is displayed by the display device 50 based on the version information 36 in this embodiment. As a result, the position of the hands 3 corresponding to the version information 36 is also stored as system setting information 33 in flash ROM 32.

The reception setting information 34 includes, for example, the time interval between automated attempts to receive satellite signals, and the timeout time for terminating the reception process when a satellite signal cannot be locked.

Local Time Information

FIG. 5 shows an example of the data structure of the local time information 35.

The local time information 35 stored in flash ROM 32 relates region information 351 (positioning information) and time difference information 352.

The time difference information 352 is information for acquiring the time difference to UTC for the region stored as the region information 351, and includes time zone information 3521, time zone change information 3522, DST offset information 3523, DST start information 3524, DST end information 3525, DST change information 3526.

The region information 351 is information identifying individual regions defined by dividing geographical information into plural regions. Each region is, for example, a rectangular region that is 1000 to 2000 km long east-west and north-south. Note that the geographical information is map information overlaid with time zones. Coordinate data defining each region is stored as the region information 351. More specifically, if each region is a rectangle, the region can be defined by the coordinates (latitude and longitude) of the top left corner and the coordinates (latitude and longitude) of the bottom right corner, and the coordinates for these two points are stored as the region information 351.

The time zone information 3521 identifies the time zone, or more specifically the time difference UTC, in each region.

The time zone change information 3522 is information indicating a scheduled change in the time zone, and includes the date and time when the time zone of the particular region changes, and the time difference to UTC after the time zone changes. For example, as shown in FIG. 5, the time difference to UTC in region 2 will change from +8 to +9 hours from 2:00 in the morning of 2014 Oct. 26.

The DST offset information 3523 indicates the offset of DST (daylight saving time) in each region.

The DST start information 3524 indicates when DST starts in each region, and DST end information 3525 indicates when DST ends in each region.

The DST change information 3526 is information indicating a scheduled change in DST, and includes the date and time when the DST setting of a particular region changes, and the offset after the change.

For example, as shown in FIG. 5, in region 3, the DST offset is +1 from the last Sunday in March to the last Sunday in October, and the DST offset starting in 2015 is 0.

FIG. 6 shows an example of a change history of the time difference information.

As shown in FIG. 6, when the time zone information, which is time difference information, or the DST information changes, new local time information is created according to the change. New version information is also applied to the new local time information. This version information is information for displaying the version of the local time information by numbers, letters, or symbols. Note that new local time information may be created each time the time zone or DST changes, or according to a specific rule, such as when a specific time has past or there is a change in a specific time zone.

By thus appropriately updating the local time information according to change in the time zone or DST, the time difference to UTC can be accurately acquired in each region.

Furthermore, by referencing the version information 36 applied to the local time information 35 stored in flash ROM 32, whether or not the local time information 35 is the same version as the most recent local time information, that is, is the newest version, can be easily determined.

Furthermore, when the local time information 35 was last updated, and what was changed, can also be known from the version information 36.

This local time information 35 is stored in flash ROM 32 at the time of manufacture or shipping. The local time information 35 may also be updated to the latest version when the timepiece is serviced. When the data is updated, all data written to the local time information 35 may be replaced, or only the data that changed may be replaced. All data, including the local time information 35, stored in flash ROM 32 may also be replaced.

Note that when the electronic timepiece 1 can communicate with a personal computer or other external device, the user can run the update process according to changes in data.

Control Device Configuration

Figure 7:
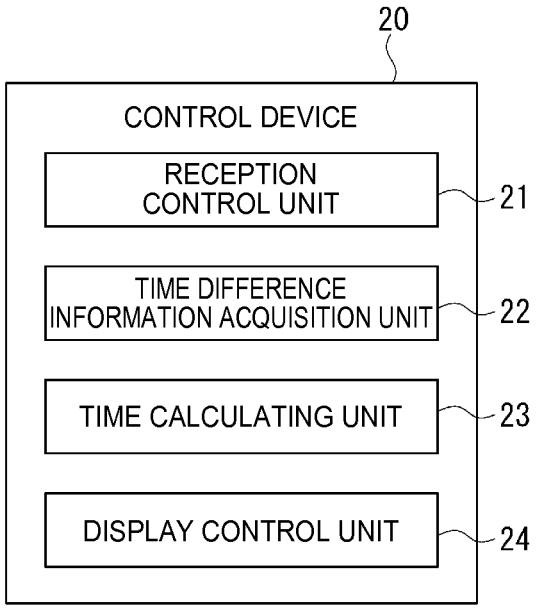
FIG. 7 is a block diagram illustrating the configuration of the control device of an electronic timepiece according to the first embodiment of the invention.

FIG. 7 is a block diagram illustrating the configuration of the control device 20.

As shown in FIG. 7, the control device 20 includes a reception control unit 21, a time difference information acquisition unit 22 as a time difference information acquisition unit, a time calculating unit 23 as a time calculating unit, and a display control unit 24 as a display control unit. The control device 20 (CPU) operates, controls, and keeps time according to a program stored in flash ROM 32. Note that timekeeping is done by counting reference signals output from a crystal oscillator circuit.

When the reception control unit 21 detects based on a signal from the input device 40 that a reception command operation was asserted by a button 7, crown 8, or other input device 40, it controls driving the GPS device 10 to execute the satellite signal reception process.

The reception control unit 21 then stores the time information acquired by the time information acquisition unit 104 of the GPS device 10 in the received time data 311.

The time difference information acquisition unit 22 acquires the time difference information 352 corresponding to the positioning information (latitude and longitude) acquired by the positioning information acquisition unit 105 of the GPS device 10 from the local time information 35. More specifically, the time difference information acquisition unit 22 identifies the region corresponding to the positioning information from the coordinates of the positioning information, and gets the time difference information 352 corresponding to the identified region.

The time calculating unit 23 then updates the internal time data 313 based on the time information (received time data 311) and leap second data 312 acquired by the GPS device 10, and based on the internal time data 313 and time difference information 352, computes the current local time (local time at the location), which is the display time. The display time data 314 is therefore updated to the calculated current time.

More specifically, the time calculating unit 23 calculates the time difference to UTC and acquires the time difference information based on the time difference information 352 linked to the region corresponding to the current location, calculates the current time using this time difference information, and updates the display time data 314. The calculated time difference information is stored in RAM 31 as the time difference data 315.

Based on the display time data 314, the display control unit 24 drives the hands 3 of the display device 50 and controls displaying the time.

Note that when the internal time data 313 is updated based on the reference signal from the oscillator circuit after time information is received, the display time data 314 is also updated by adding the time difference data 315 to the internal time data 313, and the hands 3 of the display device 50 are driven.

As described below, the display control unit 24 also drives the hands 3 to display the version information 36 in response to an input operation of the input device 40.

Version Display Process

The version display process of the electronic timepiece 1 is described next with reference to the flow chart in FIG. 8.

Figure 8:
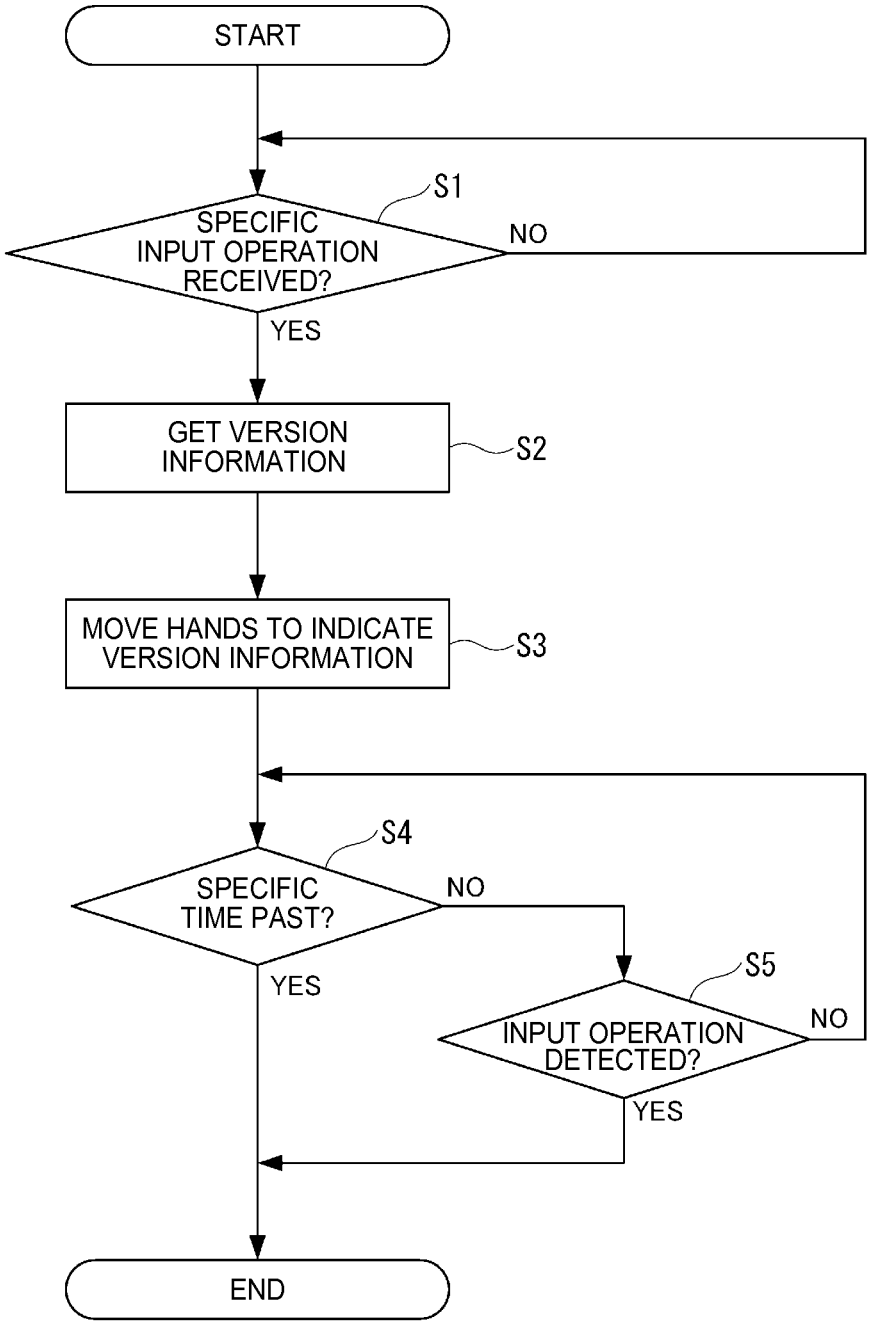
FIG. 8 is a flow chart of the version display process of the electronic timepiece according to the first embodiment of the invention.

In the version display process shown in FIG. 8, the display control unit 24 first determines if a specific input operation was received from the user (step S1), and proceeds to step S2 if the specific input operation is detected. For example, if a specific operation such as pressing a button 7 for a specific time is detected, the display control unit 24 determines that the specific input operation was received.

If the display control unit 24 detects the specific input operation, it acquires the version information 36 of the local time information 35 from flash ROM 32 (step S2).

The display control unit 24 then moves the hands 3 to the positions appropriate to the acquired version information 36, and displays the version information 36 on the display device 50 (step S3).

Figure 9:
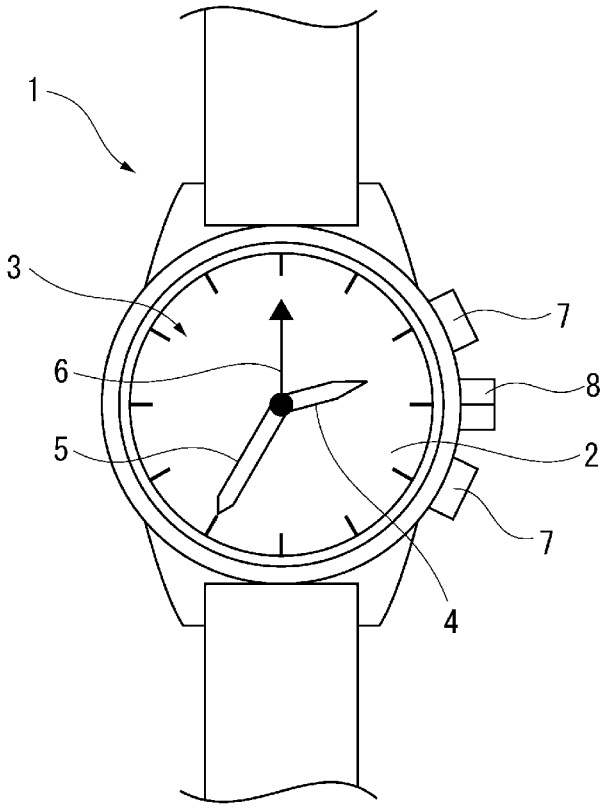
FIG. 9 shows an example of how the version information is displayed on an electronic timepiece according to the first embodiment of the invention.

FIG. 9 shows an example of displaying the version information 36.

In the example shown in FIG. 9, the version information is indicated by the hour hand 4 and minute hand 5. More specifically, if the version information is Ver. 2.35, for example, the display control unit 24 moves the hour hand 4 and minute hand 5 to the positions indicating 2:35 based on the system setting information 33 (FIG. 3) stored in flash ROM 32. In this example, the hour hand 4 indicates the integer part of the version information, and the minute hand 5 indicates the decimal part of the version information.

Instead of using the hour hand 4 and minute hand 5, the version may also be indicated using the secondhand 6 or using the secondhand 6 and minute hand 5, for example. For example, if using the second hand 6, the second hand 6 may point to the 1 second position to indicate Ver. 1, or point to the 5 second position to indicate Ver. 5. If using the minute hand 5 and second hand 6, Ver. 2.35 may be indicated by pointing to 2 m 35 s.

Referring again to FIG. 8, the display control unit 24 determines if a specific time has past after displaying the version information 36 (step S4).

If the specific time has past, the display control unit 24 terminates the version display process of the display device 50, and resumes displaying the current time, for example.

If the specific time has not past in step S4, the display control unit 24 determines if an input operation was received through the input device 40 (step S5). This input operation may be, for example, an operation instructing ending the version information display or an operation instructing executing another process.

If in step S5 the display control unit 24 determines an input operation was received, it ends the version display process. The control device 20 then executes the process called by the input operation.

However, if in step S5 the display control unit 24 determines an input operation was not received, it returns to step S4.

Effect of Embodiment 1

The effect of this embodiment of the invention is described below.

(1) The user or service technician can, by performing a specific operation, display the version information 36 of the local time information 35 by the display device 50 of the electronic timepiece 1. As a result, the user or service technician can easily confirm the version of the stored local time information 35. As a result, user or service technician can easily know that the update process is required when the local time information 35 is not the latest version. Problems arising from the update process not executing even though the update process is required can be prevented. Unnecessarily running the update process because it cannot be confirmed that the local time information 35 is the most recent even though it cannot be confirmed can also be prevented and operating efficiency can therefore be improved.

(2) The time calculating unit 23 in this embodiment of the invention uses the positioning information contained in satellite signals transmitted from the GPS satellites 9, time information carried in the satellite signals, and the local time information 35 to calculate the time at the current location corresponding to the positioning information. The display control unit 24 then controls the display device 50 to display the time at the current location corresponding to the positioning information. Thus comprised, the user can easily know if the local time information 35 that is stored is the most recent version, and easily determine if the time displayed by the display device 50 was calculated based on the latest local time information 35.

(3) The local time information 35 and version information 36 are stored rewritably in flash ROM 32. Thus comprised, of the data stored in flash ROM 32, only the local time information 35 and version information 36 can be rewritten. This configuration reduces the amount of data to be rewritten and improves efficiency compared with a configuration in which the system setting information 33 and other data stored in flash ROM 32 are also rewritten at the same time.

Furthermore, because the storage unit for storing the local time information 35 and the storage unit for storing system setting information 33 and reception setting information 34 are created in the same flash ROM 32, there is no need for a dedicated storage unit to store the local time information 35, and cost can be reduced.

(4) The local time information 35 includes region information and time zone information 3521 corresponding to the positioning information, as well as the time zone change information 3522, DST offset information 3523, DST start information 3524, DST end information 3525, and DST change information 3526. This information changes according to time zone and DST changes. As a result, when any of the information has changed, whether or not the stored local time information 35 corresponds to the changes can be easily determined by displaying the version information 36 as described in this embodiment.

(5) Because the version information 36 can be displayed using the display device 50 that displays the time, the version can be displayed without separately providing a dedicated display device for displaying the version. Increased cost as a result of providing a display device for displaying the version can therefore be suppressed. Design limitations detracting from the appearance can also be suppressed.

More particularly, because the version information 36 can be displayed using hands 3 for displaying the time and the dial used to indicate the time with the hands 3, the version can be easily checked without providing a separated dedicated dial and hands for displaying the version information 36.

Embodiment 2

A second embodiment of the invention is described next with reference to FIG. 10 to FIG. 12. Note that like parts in this and the foregoing embodiment are identified by like reference numerals and further description thereof is omitted or abbreviated.

An electronic timepiece according to the second embodiment of the invention is a radio-controlled timepiece that receives standard time signals and calculates the current time. More specifically, a radio-controlled timepiece according to this embodiment receives long-wave standard time signals carrying time information on a carrier wave with a frequency of several 10 kHz, and displays the internal time corrected based on the standard time signal. Like the electronic timepiece 1 according to the first embodiment of the invention, this radio-controlled timepiece has an analog display device 50 with a dial 2 and hands 3 including an hour hand 4, minute hand 5, and second hand 6. The radio-controlled timepiece also has an input device 40 including buttons 7 and a crown 8.

Figure 10:
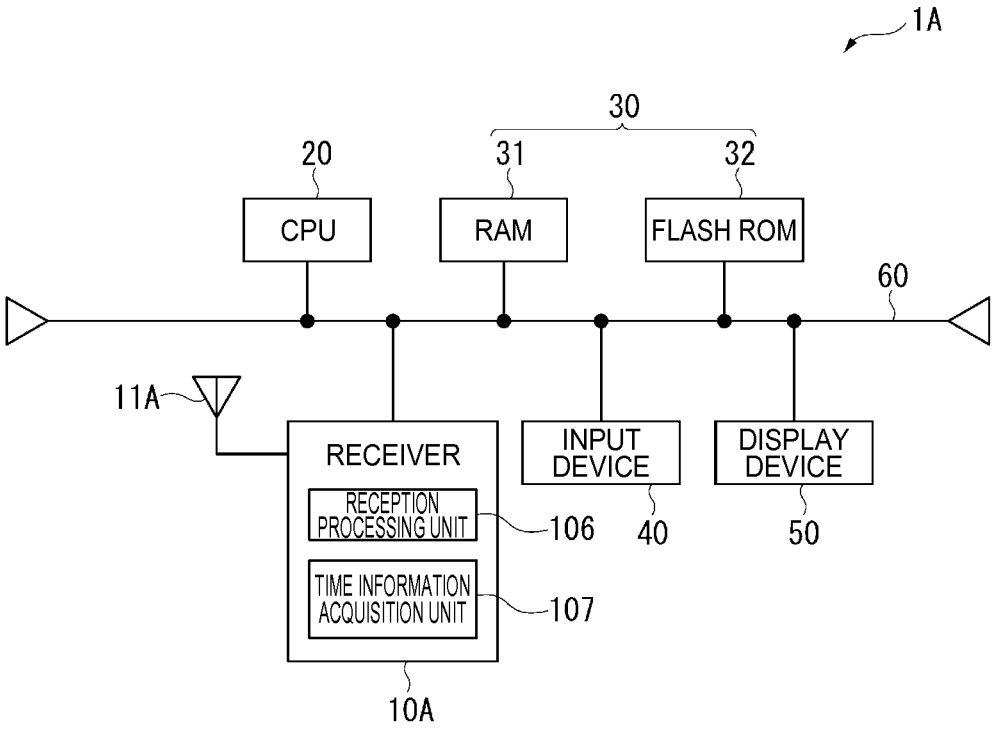
FIG. 10 illustrates the circuit design of an electronic timepiece according to the second embodiment of the invention.

FIG. 10 shows the basic circuit design of a radio-controlled timepiece according to this embodiment.

As shown in FIG. 10, the radio-controlled timepiece 1A includes a receiver 10A as the standard time signal reception unit, control device 20A (CPU), a storage device 30, an input device 40, and a display device 50 interconnected by a data bus 60. The receiver 10A also has an antenna 11A and receives standard time signals through the antenna 11A.

The storage device 30 in this embodiment also includes RAM 31 and flash ROM 32. Local time information is stored rewritably in flash ROM 32.

Local Time Information

FIG. 11 shows an example of the data structure of local time information in this embodiment.

As shown in FIG. 11, the local time information 37 includes a city code 3711 and a city name 3712 corresponding to each city code 3711 as the positioning information 371. Time zone information 3721, DST offset information 3722, DST start information 3723, and DST end information 3724 are stored as the time difference information 372 related to the positioning information 371.

The time zone information 3721 identifies the time zone relative to UTC in the city identified by the city code 3711. The DST offset information 3722, DST start information 3723, and DST end information 3724 respectively denote the DST offset, when DST starts, and when DST ends in the city identified by the city code 3711.

Receiver Configuration

The receiver 10A receives long-wave standard time signals through the antenna 11A based on control signals output from the control device 20, and includes a reception processing unit 106 that demodulates received signals, and a time information acquisition unit 107 that processes the demodulated signals and acquires the time information.

In addition to demodulating received signals, the reception processing unit 106 also identifies the different types of standard time signals transmitted in Japan, Europe (Germany and the UK), and North America. The reception processing unit 106 outputs type information identifying the type of standard time signal that was received to the control device 20. More specifically, the standard time signal JJY40 transmitted from the Fukushima station in Japan, and the German standard time signal DCF77, are transmitted at a different frequency than other standard time signals, and the type of signal can be identified by determining the reception frequency. The JJY60 standard time signal transmitted from the Kyushu station in Japan, the WWVB standard time signal transmitted in the United States, and the MSF standard time signal transmitted in the United Kingdom are transmitted at 60 kHz. The type of signal can therefore be identified by analyzing the time code when standard time signals are received at a reception frequency of 60 kHz. Note that positioning information corresponding to the location where the received standard time signal can be received can also be acquired from the signal type information.

The time information acquisition unit 107 processes the demodulated signal to acquire time information and determine if the correct time information was acquired. Note that because a standard time signal is set to the same time information for one minute, whether the correct time information is received can be determined by continuing the reception process for several minutes to acquire the full code of time information for several minutes and then comparing the time information to determine if the received times are one minute apart. The time information acquisition unit 107 performs this evaluation process, and outputs the result to the control device 20 if the correct time information was received. In this event, the internal time data 313 in the RAM 31 is updated. If the correct time information is not received, the time information acquisition unit 107 outputs a reception failure report to the control device 20.

Control Device Configuration

Figure 12:
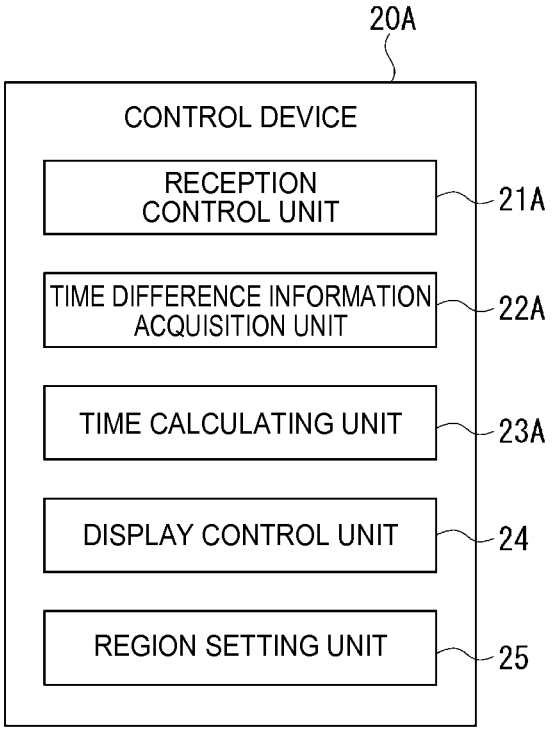
FIG. 12 is a block diagram illustrating the configuration of the control device of an electronic timepiece according to the second embodiment of the invention.

FIG. 12 is a block diagram showing the configuration of the control device 20A.

The control device 20A (CPU) operates, controls, and keeps time according to a program stored in flash ROM 32. As shown in FIG. 12, the control device 20A includes a reception control unit 21A, a time difference information acquisition unit 22A, a time calculating unit 23A, a display control unit 24, and a region setting unit 25.

The reception control unit 21A outputs control signals to the receiver 10A and controls the reception operation. The reception control unit 21A normally drives the receiver 10A in the reception operation when the internal time reaches a previously set reception process time (such as 2:00 in the morning).

The reception result from the time information acquisition unit 107 is input to the reception control unit 21A. When the reception result from the time information acquisition unit 107 indicates reception failed, the reception control unit 21A may repeat the reception process after a previously set time passes.

When time information is input from the time information acquisition unit 107, the reception control unit 21A updates the internal time data based on the received time information. After updating the internal time, the updated internal time is refreshed based on a reference signal.

Note that the reception control unit 21A may directly set the time indicated by the received standard time signal as the internal time, or convert the received time to UTC to update the internal time data.

The reception control unit 21A references the region information set by the region setting unit 25 described below, and may instruct the receiver 10A which type of standard time signal is received. For example, if the radio-controlled timepiece 1A is designed to receive standard time signals in Germany, Japan, and the United States, the reception control unit 21A may instruct receiving the German DCF77 standard time signal if the set region is Paris, the Japanese JJY standard time signal if Tokyo, and the U.S. WWVB standard time signal if New York. In this event, there is no need to execute the process that detects the type of signal received, and can reduce the processor load.

The time difference information acquisition unit 22A acquires the time difference information 372 for the location corresponding to the region information set by the region setting unit 25 from the local time information 37.

The time calculating unit 23A calculates the current local time based on the time difference information 372 acquired by the time difference information acquisition unit 22A and the internal time data. If the internal time data is updated to UTC, the time calculating unit 23A calculates the current local time in the region set by the region setting unit 25 based on the internal time data and the time difference information 372.

If the internal time data is the time information acquired from the standard time signal, the time calculating unit 23A calculates the current local time based on the time difference between the time indicated by the standard time signal and UTC, the time difference information 372 of the region set by the region setting unit 25, and the internal time data. For example, if JJY60 is received and the internal time is set to JST (UTC+9), and the user selects Paris (UTC+1) with the region setting unit 25, the current local time in Paris is calculated as the internal time minus 8 hours.

The display control unit 24 displays the current local time calculated by the time calculating unit 23A on the display device 50.

If the input device 40 is operated to display the version information, the display control unit 24 drives the hands 3 to display the version information 36.

The region setting unit 25 acquires region information for a city for which to display the time based on operation of the input device 40. For example, the user pulls the crown 8 out to the first stop to enter the set region information adjustment mode, turns the crown 8 to move the second hand 6, and sets the region information according to the position of the second hand 6. For example, the region information may be set to London (UTC) when the second hand 6 is at the 0 second position. When the second hand 6 moves to the 1 to 12 second positions, the regions with a time difference of London+1 to London+12 are set as the region information. Note that city names may be recorded on the bezel of the timepiece so that the region information can be set by moving the second hand 6 to the appropriate city name.

Further alternatively, the region setting unit 25 may set the region information by acquiring the type information of the standard time signal output from the reception processing unit 106.

The region setting unit 25 then stores the set region information in RAM 31.

Thus comprised, the region setting unit 25 functions as a positioning information acquisition unit that acquires positioning information according to the type of standard time signal and input operations. The input device 40 also functions as an input unit for setting the positioning information.

Radio-Controlled Timepiece Operation

The radio-controlled timepiece 1A receives standard time signals by the receiver 10A, and updates the internal time based on the time information contained in the standard time signal. The radio-controlled timepiece 1A also calculates and displays the current local time in other cities based on the type of standard time signal and a city corresponding to the region information acquired by an input operation.

As in the electronic timepiece 1 according to the first embodiment of the invention, the radio-controlled timepiece 1A also displays the version information 36 of the local time information 37 with the display device 50.

Effect of Embodiment 2

The radio-controlled timepiece 1A according to this embodiment of the invention enables easily checking the version information 36 of the local time information 37, and has the same effect as the first embodiment described above.

Variations

The invention is not limited to the embodiments described above, and can be modified and improved in many ways without departing from the scope of the accompanying claims.

For example, the foregoing embodiments are described a displaying the version information 36 when a specific input operation is received through the input device 40, but the invention is not so limited. For example, the version information 36 may be displayed at a specific time or a specific timing, such as when a specific signal is received.

The foregoing embodiments describe displaying the version information on the display device 50 used to display the time, but the invention is not so limited. For example, a separate display device for displaying the version information may be provided.

The method of displaying the version information is also not limited to the foregoing. For example, the date the local time information was created may be displayed as the version information. For example, 1401 may beset as the version information for local time information created in January 2014. In this event, the date display of the timepiece may show the lowest two digits of the Western year number, and the hour hand may indicate the month. For example, if the version information is 1401, 14 may be displayed in the calendar window while the hour hand points to 1:00.

The local time information is also not limited to the foregoing, and may only include positioning information (region information) and time zone information.

The version information 36 in the foregoing embodiments is generated based on updating the local time information 35, 37, but the invention is not so limited. For example, new version information 36 may also be applied when specific information other than the local time information 35, 37 stored in flash ROM 32 is updated, such as when the system setting information 33 and reception setting information 34 are updated. In this event, whether or not the system setting information 33, reception setting information 34, and local time information 35, 37 are the most recent can be determined by referencing the version information 36.

The second embodiment of the invention is described as being able to set the positioning information based both on the type of standard time signal and an input operation to the input device 40, but the invention is not so limited. For example, the positioning information may be set only in response to an input operation of the input device 40.

The foregoing embodiments are described using an analog timepiece with hands 3, but the invention can obviously also be applied to digital timepieces without hands. The invention is also not limited to wristwatches, and can be applied to pocket watches and various other electronic timepieces used as mobile devices.

The invention can also be widely applied to mobile phones having a receiver function for receiving satellite signals or standard time signal and a timepiece function, as well as various electronic devices such as navigation devices. Because the version information can be displayed on the display device by applying the invention to such electronic devices, the user or service technician can easily check the version of the local time information stored in the storage device.

The invention is also not limited to use with GPS satellites as the positioning information satellites, and may be used with other Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The invention may also be applied to electronic timepieces and electronic devices having both a receiver for receiving satellite signals from positioning information satellites and a receiver for receiving standard time signals. The invention may also be applied to electronic timepieces and electronic devices that do not have a receiver for receiving satellite signals or standard time signals but enable manually setting positioning information and time information.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application No. 2014-160384, filed Aug. 6, 2014 is expressly incorporated by reference herein.

What is claimed is:

1. An electronic timepiece comprising:

a time display unit having a plurality of hands;

a storage unit that stores local time information related to positioning information and time difference information, and version information of the local time information, wherein the version information identifies a version or edition of the local time information that changes when the content of the local time information changes;

a version display unit embodied by at least one of the plurality of hands and capable of displaying the version or edition of the version information; and a display control unit that displays the version information on the version display unit.

2. The electronic timepiece described in claim 1, further comprising:

a satellite signal receiver unit that receives satellite signals transmitted from positioning information satellites;

a time information acquisition unit that acquires time information based on the satellite signal received by the satellite signal receiver unit;

a positioning information acquisition unit that acquires positioning information based on the satellite signal received by the satellite signal receiver unit;

a time difference information acquisition unit that acquires time difference information related to the positioning information from the local time information;

a time calculating unit that computes a display time based on the time difference information and the time information; and a time display unit that displays the display time.

3. The electronic timepiece described in claim 1, further comprising:

an input unit that detects a manual operation and sets the positioning information;

a standard time signal receiver unit that receives standard time signals;

a time information acquisition unit that acquires time information based on the standard time signal received by the standard time signal receiver unit;

a positioning information acquisition unit that acquires the positioning information set by the input unit;

a time difference information acquisition unit that acquires time difference information related to the positioning information from the local time information;

a time calculating unit that computes a display time based on the time difference information and the time information; and a time display unit that displays the display time.

4. The electronic timepiece described in claim 1, further comprising:

an operating unit that receives a display command operation for the version information;

wherein the display control unit displays the version information when the operating unit receives the display command operation.

5. The electronic timepiece described in claim 1, wherein:

the storage unit rewritably stores the local time information and the version information.

6. The electronic timepiece described in claim 1, wherein:

the local time information includes region information corresponding to the positioning information, and time zone information corresponding to the time difference information and indicating the time difference of the region information to UTC, and includes relationally to the time difference information at least one of time zone change information indicating a scheduled time zone change, daylight saving time offset information, daylight saving time start information, daylight saving time end information, and daylight saving time change information indicating a scheduled change in daylight saving time.

7. The electronic timepiece described in claim 1, further comprising:

a time display unit having a plurality of hands that indicate the display time;

wherein the time display unit is used as the version display unit; and the display control unit displays the version information on the time display unit by setting the hands to positions indicating the version information.

8. An electronic device comprising:

a time display unit having a plurality of hands;

a storage unit that stores local time information related to positioning information and time difference information, and version information of the local time information, wherein the version information identifies a version or edition of the local time information that changes when the content of the local time information changes;

a version display unit embodied by at least one of the plurality of hands and capable of displaying the version or edition of the version information; and a display control unit that displays the version information on the version display unit.

* * * * *